United States Patent [19]

Hilker

[11] Patent Number: 4,582,478

[45] Date of Patent: Apr. 15, 1986

[54] VALVE OPERATED ALCOHOL LOG AND BURNER ASSEMBLY

[76] Inventor: Gloria D. Hilker, 1109 S. Landmark Trail, Hopkins, Minn. 55343

[21] Appl. No.: 769,434

[22] Filed: Aug. 26, 1985

[51] Int. Cl.[4] ..... F24C 5/04

[52] U.S. Cl. ..... 431/125; 126/92 R

[58] Field of Search ..... 126/92 R, 92 AC, 127, 126/51, 93, 96, 97; 431/125, 328, 13, 298, 319, 321

[56] References Cited

U.S. PATENT DOCUMENTS 3,817,686 6/1974 Quittner ..... 431/125
4,000,732 1/1977 White ..... 126/92 R

FOREIGN PATENT DOCUMENTS 0096111 12/1983 European Pat. Off. ..... 431/125

*Primary Examiner*—Margaret A. Focarino
*Attorney, Agent, or Firm*—Orrin M. Haugen; Thomas J. Nikolai

[57] ABSTRACT

An artificial log fireplace utilizing non-combustible logs retained in a preselected array on a support frame and a liquid fuel supply system within said support for delivering fuel to be burned adjacent the non-combustible logs. The log support frame includes an enclosed liquid fuel reservoir adjacent the rear thereof, along with first and second elongated open top fuel burning chambers. The fuel burning chambers are arranged in spaced-apart axial relationship, and each are disposed forwardly of the liquid fuel reservoir. An open top tray with upstanding walls extends across the entire bottom surface of the support frame. Wicking means are provided within the confines of each fuel burning chamber, and valve means are arranged along the conduit which is provided to deliver a fuel flow path between the fuel reservoir and the fuel burning chambers, with a hand-operated valve being arranged to interrupt the flow of fuel from the reservoir to the fuel burning chambers. By arranging the non-combustible logs in spaced-apart relationship, the flames from the fuel burning chambers may be staggered so as to be positioned both forwardly of and rearwardly of individual logs in the non-combustible log array.

4 Claims, 8 Drawing Figures

VALVE OPERATED ALCOHOL LOG AND BURNER ASSEMBLY

BACKGROUND OF THE INVENTION

The present invention relates generally to an artificial log fireplace, and more specifically to such a fireplace arrangement utilizing separate and spaced-apart fuel burning chambers so as to present a flame combination which simulates logs in a normal-appearing state of combustion. More specifically, the present invention relates to an improved artificial log fireplace which is provided with a plurality of fuel burning chambers, with the fuel burning chambers being, in turn, coupled to a separately disposed liquid fuel reservoir, with the flow of the fuel being controlled by a single hand-operated valve. For added safety, a tray or catch-pan is disposed at the base of the frame in order to capture and enclosure any liquid fuel that may inadvertently be spilled from the system.

In the past, artificial log fireplaces have been provided which utilize non-combustible logs retained in a preselected array on a support frame. Typically, these systems are fueled by liquid or gaseous fuel, and are normally presentable and provide a relatively safe and convenient alternative to a conventional solid fuel burning fireplace. Because of prohibitive costs involved in the erection of conventional solid fuel burning fireplaces, artificial log fireplaces have become a relatively popular alternative to such conventional fireplaces.

In the past, artificial log fireplaces have been designed with grates or the like disposed beneath the artificial or non-combustible logs, and the convection currents have been relied upon to generate a flow path or pattern for the flames arising from the source of the combustible fuel. While a haphazard arrangement of artificial logs may be appropriate and useful in a gas-fired system, liquid fuel systems employing alcohol as a fuel have been found to require careful positioning of the logs in order to achieve a desirable combination and/or pattern of flame. Also, alcohol either in the form of lower alkyl alcohols of methanol and ethanol are the fuels of choice, since such materials burn at a relatively controllable rate and are not deemed as hazardous as gasoline, kerosene, fuel oil or the like. Also, the products of combustion from lower alkyl alcohols are substantiall entirely carbon dioxide and water, with carbon monoxide being present in such small quantities that risks or hazards from the generation of such gases are not present in normal installations.

SUMMARY OF THE INVENTION

Briefly, in accordance with the present invention, an artificial log fireplace is provided which utilizes non-combustible logs retained in a preselected array on a support frame. A liquid fuel supply system is provided with the support frame for delivering fuel to be burned at points adjacent the non-combustible logs. The log support frame includes an enclosed liquid fuel or alcohol reservoir adjacent the rear thereof, and first and second elongated open top fuel burning chambers are disposed in spaced-apart axial relationship, one to another, with each of the fuel burning chambers being disposed forwardly of the liquid fuel reservoir. An open top tray is provided across the bottom of the support frame in order to provide a catch-pan for any liquid fuel that may be spilled from the system during the fuel filling operation, for example. Typically, each of the fuel burning chambers is provided with a wicking means in order to assist in initial ignition, and later burning, and the walls of the fuel burning chambers defining the open top thereof are disposed along a plane which is elevated to a point substantially equal to the plane of the top of the reservoirs. A conduit means extends from the base of the liquid fuel or alcohol reservoir to each of the fuel burning chambers, and provides for communication between the reservoir and the fuel burning chambers. The hand-operated valve is disposed along the conduit in order to control fuel flow therealong. In order to provide a pleasing affect to the viewer-user, a gap is interposed between the individual logs forming the array, with the gap being positioned substantially along a vertical axis adjacent the rearwardly disposed fuel burning chamber.

A filler tube is provided along the base of the reservoir, and for ease of checking the extent of fill in the reservoir, a calibrated dipstick is provided. Also, the top of the filler tube is disposed along a plane which is no higher than the top plane of the fuel burning chamber.

The hand-operated valve is typically disposed along the conduit extending between the reservoir and the fuel burning chambers, with the hand-operated valve having a gripping handle disposed adjacent the edge of the catch-pan and laterally outwardly thereof. If desired, the fuel burning chambers may be provided with angularly offset segments so as to provide a modified form of flame pattern.

Therefore, it is a primary object of the present invention to provide an improved artificial log fireplace utilizing non-combustible logs retained in a preselected array on a support frame, with the support frame including an enclosed liquid fuel or alcohol reservoir adjacent the rear thereof, and with first and second elongated open top fuel burning chambers arranged in spaced-apart axial relationship forwardly of the reservoir.

It is yet a further object of the present invention to provide an improved artificial log fireplace utilizing non-combustible logs retained in a preselected array, and wherein a plurality of fuel burning chambers are arranged in spaced-apart front-to-back axial relationship relative to a liquid fuel reservoir, and with valve containing conduit means providing fluid communication between the reservoir and the fuel burning chambers.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
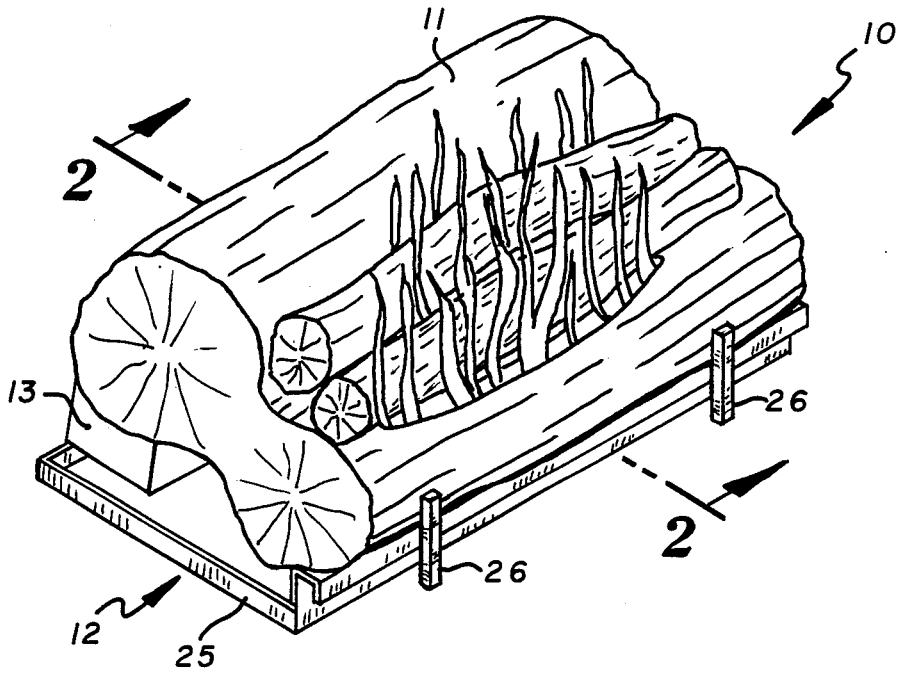
FIG. 1 is a perspective view of the assembled artificial log fireplace of the present invention, with the logs being shown in a preselected array and on a support frame in accordance with the present invention.
Figure 2:
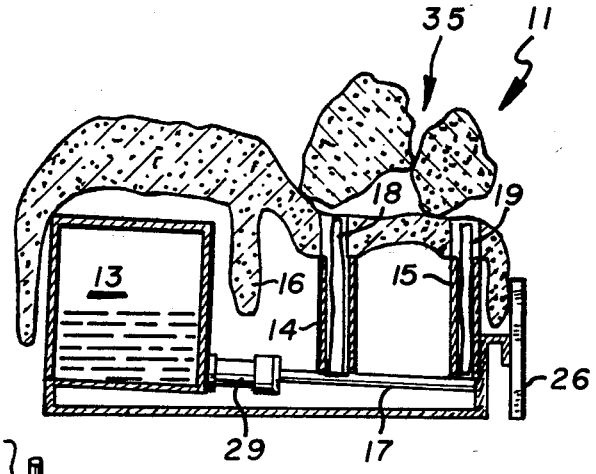
FIG. 2 is a vertical sectional view taken along the line and in the direction of the arrows 2—2 of FIG. 1.
Figure 3:
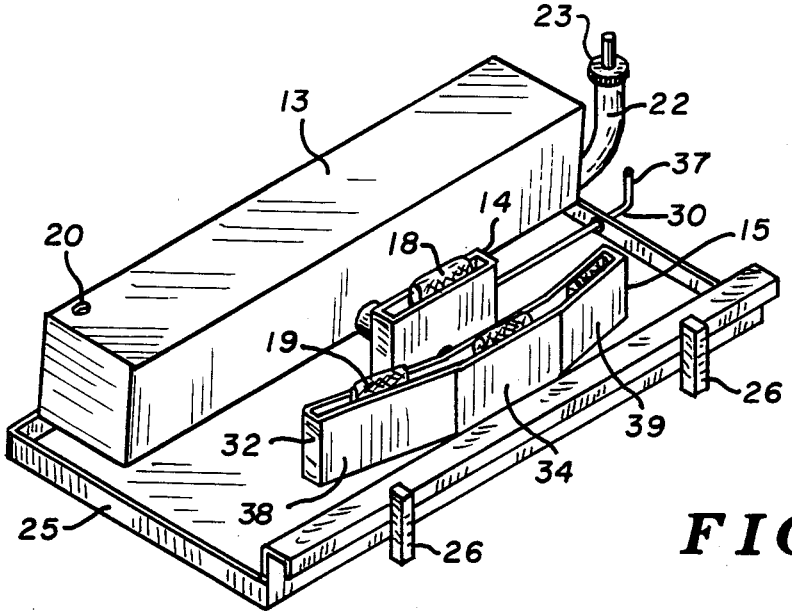
FIG. 3 is a perspective view of the support frame assembly including the fuel supply system of the present invention.

With particular attention being directed to FIGS. 1-3 of the drawings, the artificial log fireplace assembly generally designated 10 includes a plurality of non-combustible logs retained in a preselected array, as at 11, on a support frame generally designated 12. The support frame includes a liquid fuel supply system, with the system including a liquid fuel reservoir 13 for delivering fuel to be burned adjacent the non-combustible logs in the array. The liquid fuel is, for safety and efficacy purposes, a lower alkyl alcohol such as methanol or ethanol although other suitably low melting point alcohols may be utilized. The support frame 12 includes the enclosed liquid fuel reservoir 13, which is arranged adjacent the rear of the overall assembly. A pair of liquid fuel burning chambers are provided, as at 14 and 15, with these fuel burning chambers being elongated as illustrated, for example, in FIG. 3. The chambers 14 and 15 are in spaced-apart axial relationship, with the fuel burning chamber 15 being disposed or positioned forwardly of the fuel burning chamber 14. As is apparent in FIG. 2 of the drawing, a downwardly extending heat retaining baffle member or wall 16 is arranged for protecting and/or isolating the liquid fuel reservoir 13 from the heated area. In this manner, therefore, the zone disposed forwardly of wall 16 may be heated or warmed without causing a corresponding elevation of temperature within the zone occupied by the liquid fuel reservoir 13. To enhance the protection feature, wall 16 may be provided with a heat-reflective surface. A conduit line as at 17 transmits fuel from the reservoir 13 to the fuel burning chambers, with wicks 18 and 19 being disposed within the chambers 14 and 15 respectively to aid in the burning process. In order to provide efficient flow of the liquid fuel, alcohol, a vent hole 20 is provided in reservoir 13. Also, to permit re-filling, fill pipe 22 is provided with a cap 23, with cap 23 being provided with a inwardly extending dipstick 24 (FIG. 5) to indicate the extent of fuel capacity remaining in the reservoir 13.

An open top tray or catch pin 25 is provided at the base of the frame, and is held in place by support cradle or frame members 26—26. The tray or catch pan 25 is utilized to retain any liquid fuel that may be spilled so as to reduce the fire hazard during use.

Figure 7:
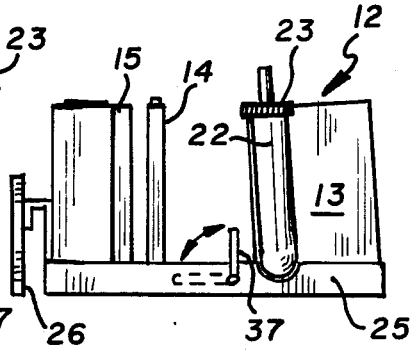
FIG. 7 is a side elevational view of the support frame of the non-combustible logs in accordance with the present invention.
Figure 8:
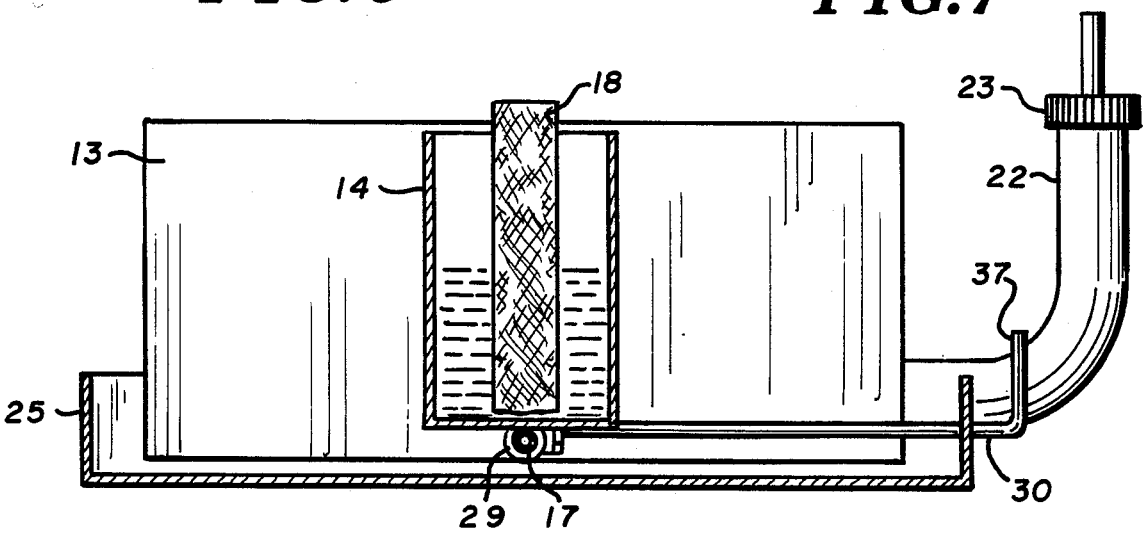
FIG. 8 is a vertical sectional view taken along the line and in the direction of the arrows 8—8 of FIG. 4.

In order to control the flow of fluid through conduit 17, a ball valve is provided as at 29, with the valve 29 being controlled by a valve control rod 30. Rotation of the ball valve 29 by means of rod 30 opens and closes the valves in the on-and-off dispositions illustrated in FIG. 7.

Figure 4:
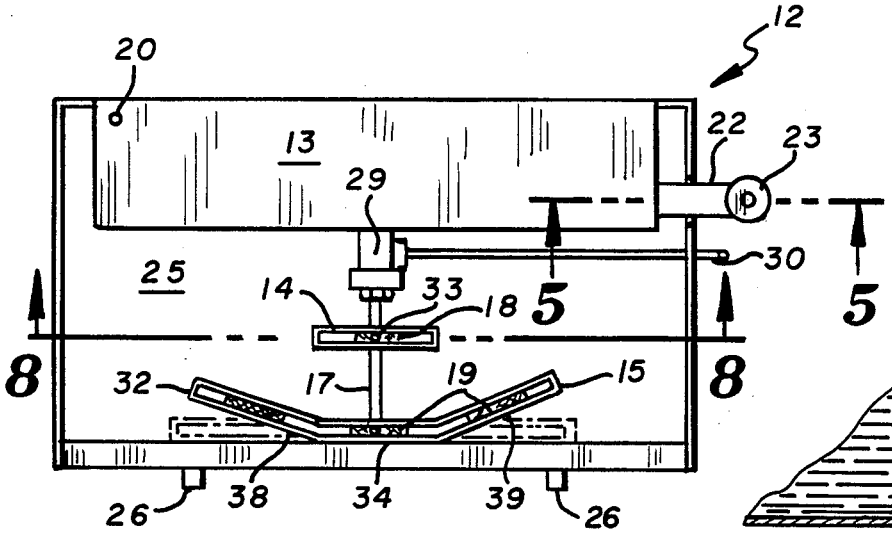
FIG. 4 is a top plan view of the artificial log fireplace support frame arranged in accordance with the present invention.

The fuel burning chambers are preferably fabricated from steel or other durable material, and are provided with an upper lip 32 which is at least as high or elevated to an extent such that the level of fill within the reservoir will not overflow the individual fuel burning chambers, thereby contributing further to safe utilization of the device. In other words, the walls defining the open top of each of the fuel burning chambers are disposed along a plane which is elevated to the level substantially at the plane of the top of the liquid fuel reservoir. Also, in order to provide ingress of fuel from the reservoir to the individual fuel burning chambers, fuel inlet holes are provided at 33 and 34, as illustrated in FIG. 4 of the drawings.

With attention being re-directed to FIGS. 1 and 2 of the drawings, the non-combustible logs each have an elongated axis, and are positioned in spaced-apart axial relationship, with a flame-accommodating gap arranged therebetween. The gap is illustrated generally at 35. The flame-accommodating gap is positioned substantially along a vertical axis adjacent fuel burning chamber 14. With respect to the view of FIG. 4, it will be noted that burner chamber 15 may be formed as a rectangular chamber, as illustrated in phantom in the forward portion of FIG. 4.

It will be noted that the front barrier chamber can be designed to be angularly disposed relative to the second burner chamber, and may, in certain instances, be arranged generally perpendicular to the second burner chamber. It is noted, however, that a gap or spacing should be provided between the two fuel burning chambers so as to maintain proper burning efficacy.

Figure 5:
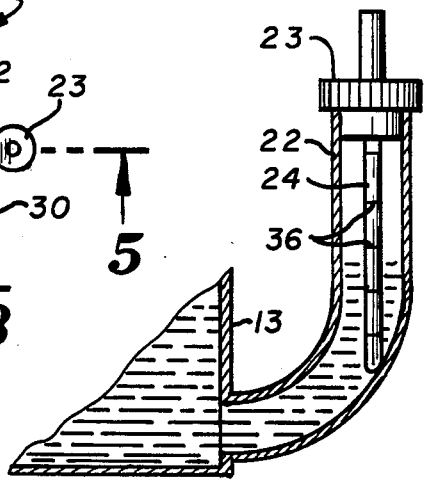
FIG. 5 is a fragmentary view, on a slightly enlarged scale, of the filler pipe utilized for the fuel supply of the present invention.

With attention now being directed to FIG. 5 of the drawings, dipstick 24 is provided with calibration lines as at 36—36 in order to inform the user of the extent of fuel volume remaining.

Figure 6:
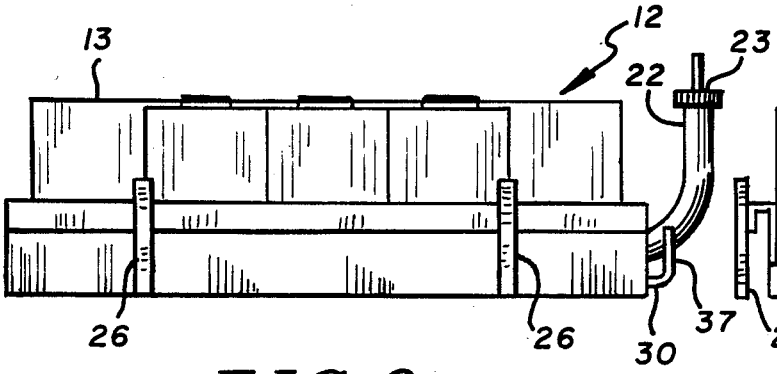
FIG. 6 is a front elevational view of the support frame of the non-combustible logs in accordance with the present invention.

As is illustrated in FIGS. 3 and 6, the hand-operated valve 30 is provided with a gripping handle as at 37, which is laterally adjacent the pan 25, so as to permit ease of opening and closing of the valve.

In order to further contribute to the aesthetics of the flame emanating from the system, it will be noted in FIGS. 3 and 4 that fuel burning chamber 15 is provided with arcuately bent segments 38 and 39, each of which converge toward fuel burning chamber 14. This angular offset provides enhanced utilization of the area, and contributes to the aesthetics of the overall device.

What is claimed is:

1. In an artificial log fireplace utilizing non-combustible logs retained in a preselected array on a support frame and a liquid fuel supply system within said support frame for delivering fuel to be burned adjacent the non-combustible logs in said array; said artificial log fireplace being characterized in that:

(a) said log support frame includes:
   1. an enclosed liquid fuel reservoir adjacent the rear thereof; and
   2. first and second elongated open top fuel burning chambers arranged in spaced-apart axial relationship relative to said liquid fuel reservoir with said first fuel burning chamber being positioned forwardly of said second fuel burning chamber and with each fuel burning chamber being disposed forwardly of said liquid fuel reservoir; and
   3. an open top tray means with upstanding side and end walls extending across the entire bottom surface of said support frame;

(b) said fuel burning chambers each having wicking means disposed within the confines thereof;

(c) the walls defining the open top of each of said fuel burning chambers being disposed along a plane which is elevated to the level substantially at the plane of the top of said liquid fuel reservoir;

(d) conduit means extending from the base of said liquid fuel reservoir to each of said fuel burning chambers and providing for communication and fuel flow therebetween, and hand-operated valve means interposed along said conduit means between said liquid fuel reservoir in said fuel burning chambers; and (e) said non-combustible logs having an elongated axis and being positioned in spaced-apart relationship and with a flame-accommodating gap therebetween, said flame-accommodating gap being positioned substantially along a vertical axis adjacent said second fuel burning chamber.

2. The artificial log fireplace as defined in claim 1 being particularly characterized in that a filler tube is provided for said enclosed liquid fuel reservoir communicating with the reservoir of the base thereof, and a dipstick is provided within said filler tube calibrated to indicate the extent of fuel volume remaining in said liquid fuel reservoir, the top of the filler tube being at a plane no higher than the top plane of said fuel burning chambers.

3. The artificial log fireplace as defined in claim 1 being particularly characterized in that a hand-operated valve with gripping handle means disposed adjacent the edge of said tray and laterally outwardly thereof.

4. The artificial log fireplace as defined in claim 1 being particularly characterized in that said first fuel burning chamber comprises segments which are angularly disposed relative to said second fuel burning chamber.

* * * * *

UNITED STATES PATENT AND TRADEMARK OFFICE

CERTIFICATE OF CORRECTION

PATENT NO. : 4,582,478

DATED : April 15, 1986

INVENTOR(S) : Gloria D. Hilker

It is certified that error appears in the above-identified patent and that said Letters Patent are hereby corrected as shown below:

Column 5, Line 11, "axial" should be inserted after -- spaced-apart --.

Signed and Sealed this

*Fifteenth* Day of *July 1986*

[SEAL]

*Attest:*

DONALD J. QUIGG

*Attesting Officer*

*Commissioner of Patents and Trademarks*